US008997898B2

(12) United States Patent
Fyfe

(10) Patent No.: US 8,997,898 B2
(45) Date of Patent: Apr. 7, 2015

(54) DRILLING EQUIPMENT AND ATTACHMENT MEANS FOR THE SAME

(75) Inventor: George Fyfe, Lonsdale (AU)

(73) Assignee: Transco Manufacturing Australia Pty Ltd, Lonsdale, South Australia (AU)

( * ) Notice: Subject to any disclaimer, the term of this patent is extended or adjusted under 35 U.S.C. 154(b) by 727 days.

(21) Appl. No.: 13/318,727

(22) PCT Filed: Nov. 30, 2009

(86) PCT No.: PCT/AU2009/001559
§ 371 (c)(1),
(2), (4) Date: Jan. 3, 2012

(87) PCT Pub. No.: WO2010/127382
PCT Pub. Date: Nov. 11, 2010

(65) Prior Publication Data

US 2012/0103695 A1 May 3, 2012

(30) Foreign Application Priority Data

May 8, 2009 (AU) ..... 2009902048

(51) Int. Cl.
*E21B 10/633* (2006.01)

(52) U.S. Cl.
CPC ..... *E21B 10/633* (2013.01)

(58) Field of Classification Search
USPC ..... 175/413, 344, 346, 366, 363, 406
See application file for complete search history.

(56) References Cited

U.S. PATENT DOCUMENTS

| | | | | |
|---|---|---|---|---|
| 2,065,743 | A | 12/1936 | Reed | |
| 3,917,011 | A | 11/1975 | Hester | |
| 4,548,284 | A | 10/1985 | Shinn et al. | |
| 4,630,693 | A | 12/1986 | Goodfellow | |
| 6,902,014 | B1 | 6/2005 | Estes | |
| 7,152,702 | B1 | 12/2006 | Bhome et al. | |
| 7,458,430 | B2 * | 12/2008 | Fyfe | 175/342 |
| 2002/0108785 | A1 | 8/2002 | Slaughter, Jr. et al. | |
| 2006/0260848 | A1 | 11/2006 | Fyfe | |

FOREIGN PATENT DOCUMENTS

| | | | |
|---|---|---|---|
| CN | 1742151 | A | 3/2006 |
| WO | WO 2008/076117 | A1 | 6/2008 |

OTHER PUBLICATIONS

Office Action for Japanese Application No. 2012-508853 dated Sep. 24, 2013.

(Continued)

*Primary Examiner* — David Andrews
(74) *Attorney, Agent, or Firm* — Alston & Bird LLP

(57) ABSTRACT

This invention relates to a ground drilling or cutting tool comprising a cutting element removably attached thereto by attachment means, the tool further including retention means adapted to maintain attachment of the cutting element to the tool in the event that the attachment means fails. The retention means comprises a first surface on a side of the cutting element, a mounting recess in the cutting tool in which at least a portion of said cutting element locates, a second surface in a side of the mounting recess against which said first surface locates, channels in each of said first and second surfaces that align so as to cooperatively define a dowel hole when said first and second surfaces locate together, at least one dowel that locates in the dowel hole, and means for retaining the or each dowel within the dowel hole.

21 Claims, 3 Drawing Sheets

(56) References Cited

OTHER PUBLICATIONS

Office Action for Chinese Application No. 20980159179.2 dated Aug. 27, 2013.

International Search Report for International Application No. PCT/AU2009/001559, mailed Dec. 23, 2009.

* cited by examiner

DRILLING EQUIPMENT AND ATTACHMENT MEANS FOR THE SAME

BACKGROUND OF THE INVENTION

This invention relates to a ground drilling or cutting tool, and to an attachment means for attaching cutting elements to ground drilling or cutting tools.

Some ground drilling or cutting tools comprise one or more cutting elements and it is desirable for those cutting elements to be replaceable. This enables damaged cutting elements to be replaced or worn cutting elements to be removed for re-work.

The working conditions for drilling equipment are exceedingly arduous and it is very difficult to construct drilling equipment so that the cutting elements are removable. The most reliable and easiest way of attaching cutting elements to a cutting tool is to fix them in place by welding.

For example, a cutting element may comprise a roller cone which is rotatably secured to an arm, where the arm is in turn welded to the body of the drilling or cutting tool. A number of such cutting elements may be spaced around the periphery of the drilling or cutting tool.

Welding of the cutting elements to the cutting or drilling tool presents some difficulty in maintaining the cutting element though. Massive rotary drilling tools can each have a large number of cutting elements that will each require, on a periodic basis, to be re-worked or replaced. Obviously, in the case of a welded cutting element, the re-working must occur with the cutting element in situ. Given that some drilling and cutting tools may be quite large, such an operation becomes quite a task.

In addition, when the cutting elements finally become unserviceable, then it is more likely for the drilling or cutting tool to be discarded in its entirety rather than attempting to rework the tool by removing cutting elements.

Cutting tools and elements of the above described type are well known to the applicant. The applicant's previous attempts to overcome at least some of the problems associated with the above described cutting tools and elements is disclosed in their earlier filed PCT application WO/2004/065752, also entitled ATTACHMENT MEANS FOR DRILLING EQUIPMENT, the content of which should be considered included herein by way of reference. This earlier application discloses an attachment means wherein there is a first surface on the cutting element, a second surface on the tool upon which the first surface locates, dowel holes in each of the first and second surfaces, dowels that locate in aligned dowel holes between said surfaces. Also provided are engagement surfaces on the cutting element and tool that extend substantially parallel to the longitudinal axis of the tool and engage to resist side loads applied to the cutting elements and fastening means that secures the cutting elements to the tool. This arrangement provides a means of easily removing the cutting elements from the tool for either replacement or maintenance work.

It is an object of the present invention therefore to provide a ground drilling or cutting tool having improved (at least when compared with the disclosure of the applicant's above mentioned earlier filed patent application) cutting tool retention, or at least provide an attachment means that is a useful alternative to known attachment means.

Other objects and advantages of the present invention will become apparent from the following description, taking in connection with the accompanying drawings, wherein, by way of illustration and example, an embodiment of the present invention is disclosed.

SUMMARY OF THE INVENTION

In one aspect of this invention, there is proposed a ground drilling or cutting tool comprising a cutting element removably attached thereto by attachment means, and releasable retention means adapted to maintain attachment of the cutting element to the tool in the event that the attachment means fails.

In one form, the ground drilling or cutting tool is a hole opener or reamer.

In one form, said retention means comprises:

a first surface on a side of the cutting element, a mounting recess on the cutting tool in which at least a portion of said cutting element locates, a second surface in a side of the mounting recess against which said first surface locates, channels in each of said first and second surfaces that align so as to cooperatively define a dowel hole when said first and second surfaces locate together, at least one dowel that locates in the dowel hole, and means for retaining the or each dowel within the dowel hole.

In one form, the means for retaining the or each dowel comprises a recess in the or each dowel, for each dowel a bolt hole extending substantially normal to and at least partially intersecting the dowel hole, for each bolt hole a bolt that locates in said bolt hole when and only when the recess in the dowel is aligned with the bolt hole, the bolt thereby securing the dowel in its dowel hole, and the dowel aiding to secure the cutting element to the cutting tool.

In one form, the attachment means comprises a surface on an underside of a base of the cutting element, and a further surface on a floor of the mounting recess upon which the base underside surface locates, a further set of dowel holes in each of the underside and floor surfaces, and a further set of dowels that locate in the aligned further set of dowel holes between said surfaces.

In one form, the cutting element includes an arm supported by a base, where said base locates in the recess and a side of said base is the first surface that locates against the second surface.

In one form, the recess in the dowel is a circumferential groove extending there around.

In one form, the recess in the dowel is a hole through the dowel.

In one form, the base comprises a pair of substantially oppositely facing side surfaces, and the recess comprises a pair of matching second surfaces in the sides thereof, where each pair of matching first and second faces cooperatively define dowel holes.

In one form, each of the two dowel holes accepts two dowels, and for each dowel there is a bolt hole receiving a bolt that registers in the circumferential groove of one of the four dowels.

In one form, there is also a provided a surface on the underside of the base of the cutting element, and a further surface on the floor of the recess upon which the base underside surface locates, a further set of dowel holes in each of the underside and floor surfaces, and a further set of dowels that locate in the aligned further set of dowel holes between said surfaces.

In one form, there are engagement surfaces on the underside of the cutting element and floor of the mounting recess that extend substantially parallel to the longitudinal axis of the tool and engage to resist side loads applied to the cutting elements, and fastening means that secure the cutting elements to the tool.

In one form, these engagement surfaces comprise a channel located on the floor of the mounting recess in the drilling or cutting tool and a projection to engage the channel on the underside of the base of the cutting element.

In one form, the engagement surfaces comprise channel located on the underside of the base of the cutting element, and projection to engage the channel on the floor of the mounting recess in the drilling or cutting tool.

In one form, the further set of dowels locate within each of the dowel holes and resist movement in a direction that is parallel to the longitudinal axis of the drilling or cutting tool.

In one form, the fastening means comprises a plurality of bolts which locate through corresponding holes in the underside surface and engage in threaded holes in the floor surface.

In one form, clearance is provided between the holes in the underside surface and the bolts so that minimal shear loading is applied to the bolts.

The second set of dowels locate within each of the dowel holes and resist movement in a direction that is parallel to the longitudinal axis of the drilling or cutting tool. In one form, the fastening means comprises a plurality of bolts which locate through corresponding holes in the underside surface and engage in threaded holes within the floor surface. Preferably, clearance is provided between the holes in the underside surface and the bolts so that minimal shear loading is applied to the bolts. Instead, shear forces along the longitudinal axis of the drilling or cutting tool are restrained by the second set of dowels. This prevents damage to the bolts which may in turn create difficulty with disassembly.

In a further aspect, the invention may be said to reside in an attachment means for removably securing a cutting element to a ground drilling or cutting tool, said attachment means comprising:

a first surface on a side of a cutting element, a cutting tool including a mounting recess in which at least a portion of said cutting element locates, a second surface in a side of the mounting recess against which said first surface locates, channels in each of said first and second surfaces that align so as to cooperatively define a dowel hole when said first and second surfaces locate together, at least one dowel that locates in the dowel hole, and means for retaining the or each dowel within the dowel hole.

In one form, the means for retaining the or each dowel comprises a recess in the or each dowel, for each dowel a bolt hole extending substantially normal to and at least partially intersecting the dowel hole, for each bolt hole a bolt that locates in said bolt hole when and only when the recess in the dowel is aligned with the bolt hole, the bolt thereby securing the dowel in its dowel hole, and the dowel aiding to secure the cutting element to the cutting tool.

In one form, the cutting element includes an arm supported by a base, where said base locates in the recess and a side of said base is the first surface that locates against the second surface.

In one form, the recess in the dowel is a circumferential groove extending there around.

In one form, the recess in the dowel is a hole through the dowel.

In one form, the base comprises a pair of substantially oppositely facing side surfaces, and the recess comprises a pair of matching second surfaces in the sides thereof, where each pair of matching first and second faces cooperatively define dowel holes.

In one form, each of the two dowel holes accepts two dowels, and for each dowel there is a bolt hole receiving a bolt that registers in the circumferential groove of one of the four dowels.

In this respect, before explaining at least one embodiment of the invention in detail, it is to be understood that the invention is not limited in its application to the details of construction and to the arrangements of the components set forth in the following description or illustrated in the drawing. The invention is capable of embodiments in addition to those described and of being practiced and carried out in various ways. Also, it is to be understood that the phraseology and terminology employed herein, as well as the abstract, are for the purpose of description and should not be regarded as limiting.

The accompanying drawings, which are incorporated in and constitute a part of this specification, illustrate certain embodiments of the invention, and together with the description, serve to explain the principles of the invention.

Those skilled in the art will appreciate that the conception upon which this disclosure is based may readily be utilized as a basis for designing other structures, methods, and systems for carrying out the several purposes of the present invention. It is important, therefore, to recognise that the claims should be regarded as including such equivalent constructions insofar as they do not depart from the spirit and scope of the present invention.

BRIEF DESCRIPTION OF THE DRAWINGS

For a better understanding of this invention it will now be described with respect to an exemplary embodiment which shall be described herein with the assistance of drawings wherein.

In the following description, like reference characters designate like or corresponding parts throughout the several views of the drawings.

DETAILED DESCRIPTION

The exemplary embodiments described and shown in the representations are generally used in relation to a drilling or cutting tool known as a hole opener or reamer. This cutting tool acts to open a small diameter hole to a larger diameter and uses multiple conical roller cutters to achieve cutting of the rock or earth. This exemplary embodiment relates to the attachment of those roller cutters to the main body of the hole opener or hole reamer.

Figure 1:
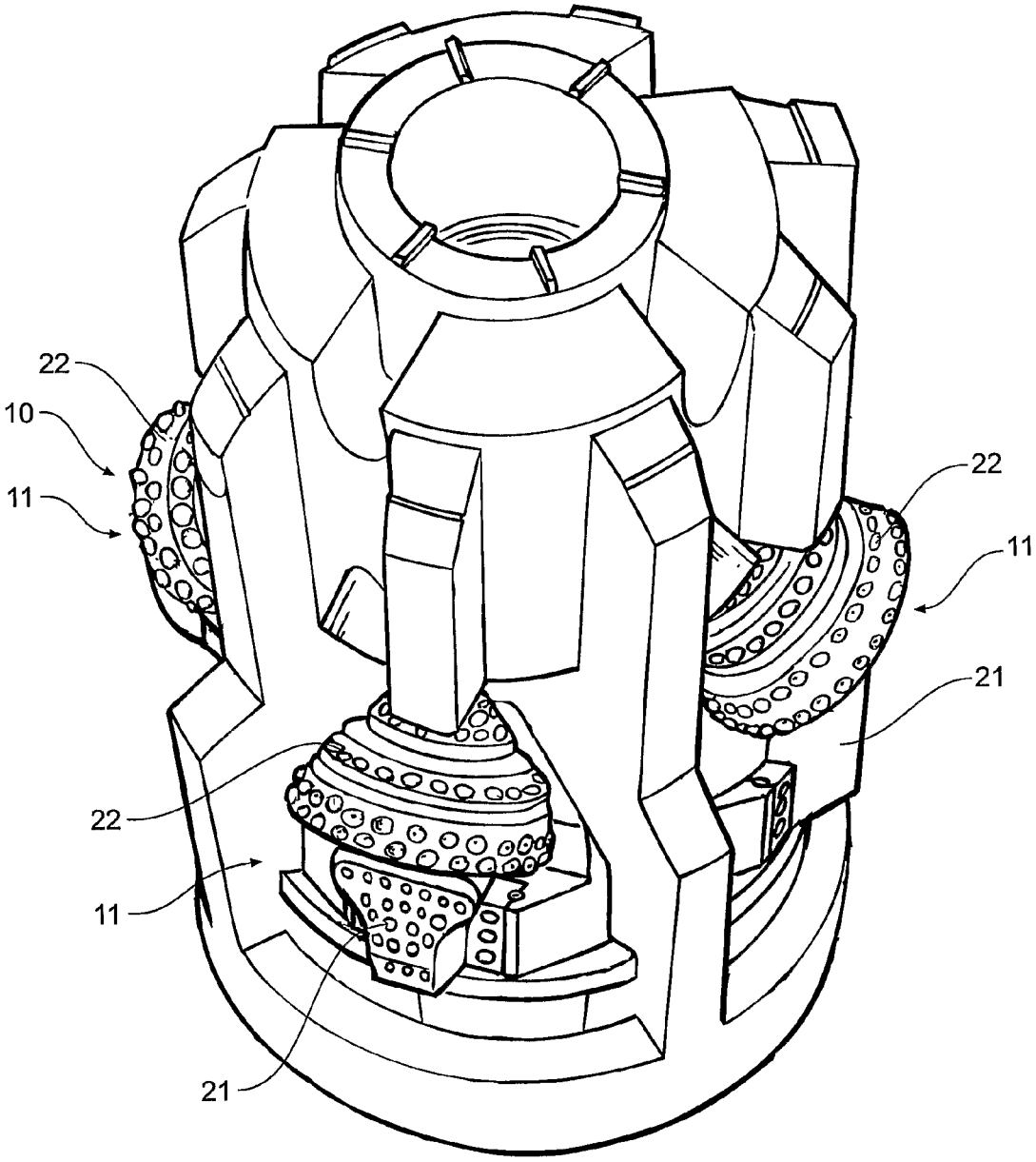
FIG. 1 shows a perspective view of a cutting tool.

FIG. 1 shows a drilling tool 10 incorporating the number of cutting elements 11 around the periphery of the tool 10. In this embodiment, the cutting elements 11 comprise conical roller cutters.

Figure 2:
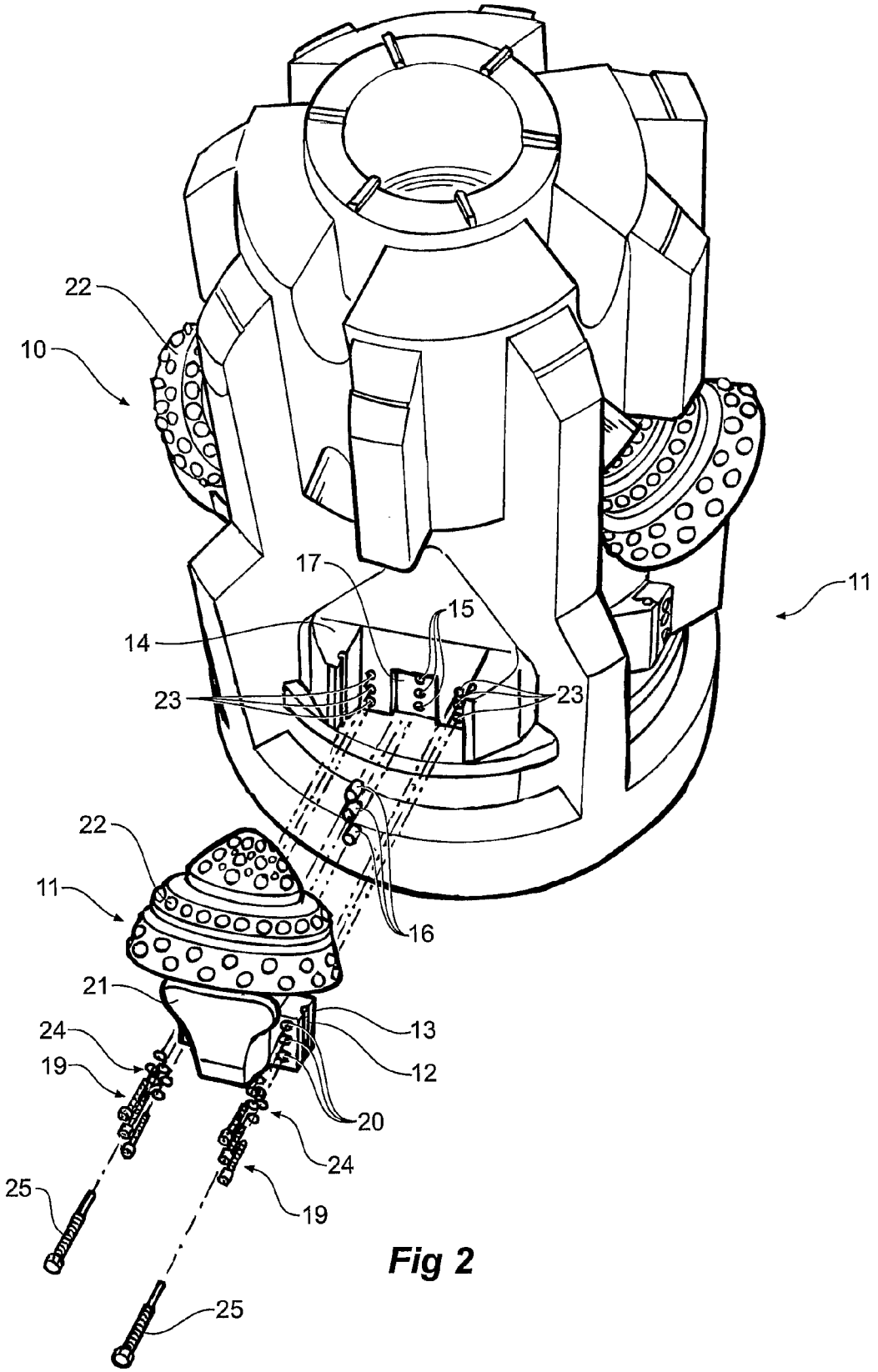
FIG. 2 is an exploded perspective view of the cutting tool of FIG. 1, where a cutting element and its attachment means are shown exploded from the cutting tool.
Figure 3:
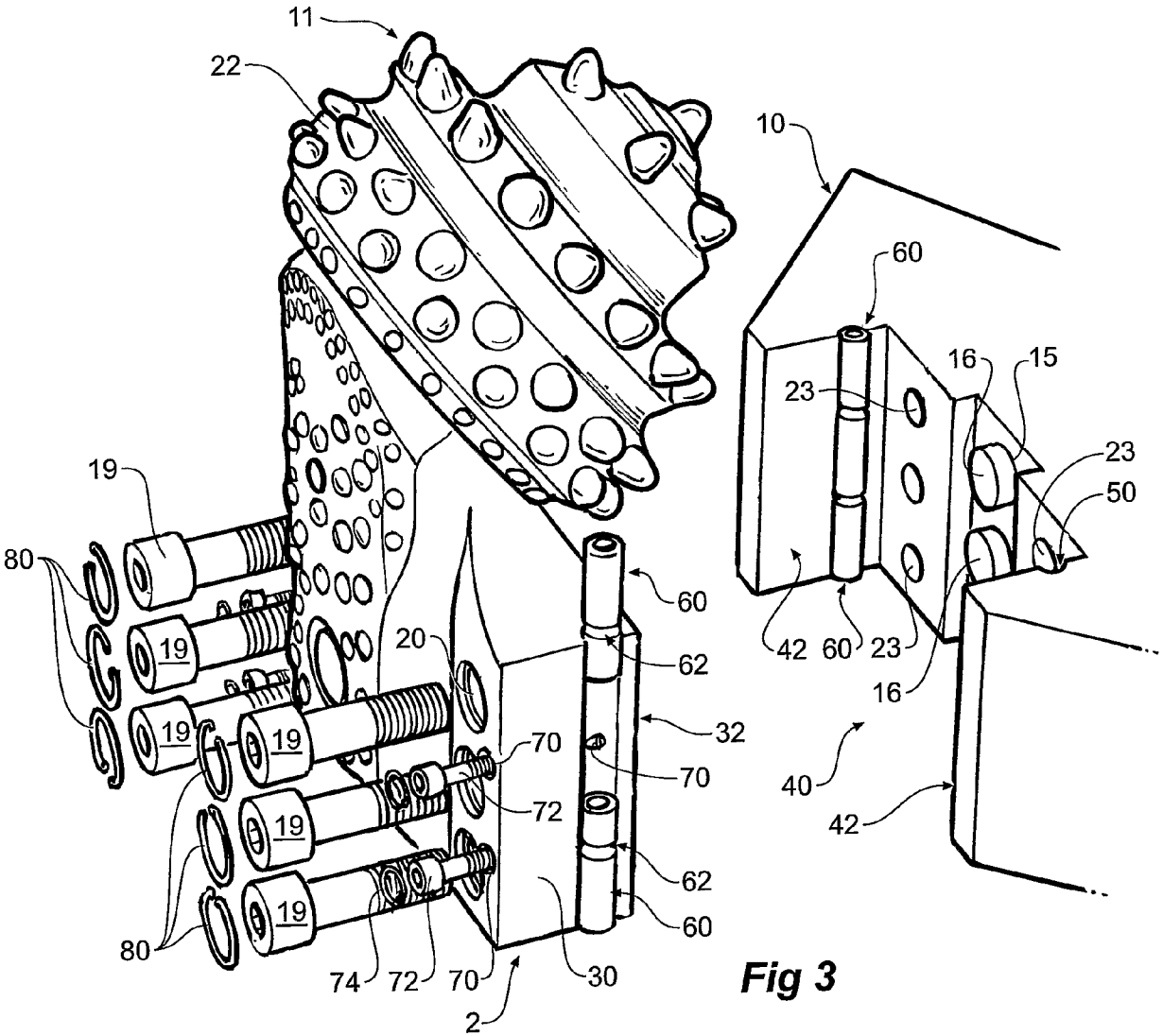
FIG. 3 shows a detailed perspective view of the cutting element and attachment means illustrated in FIG. 2.

As seen in FIG. 2, an attachment means is used to fix the cutting elements 11 to the drilling tool 10. In this embodiment, the cutting elements 11 comprise an arm 21 extending from a roller cutter 22, where the arm 21 is secured to a base, the base being in the form of a mounting box 12 (hereinafter therefore, the term mounting box will used in place of the word base). The arm 21 is secured to the mounting box 12 by welds.

The mounting box 12 comprises at least a first pair of generally planar surfaces on oppositely facing sides 30 thereof, and a generally planar underside surface 32.

The drilling tool comprises a mounting recess 40 in which said mounting box 12 locates. This mounting recess 40 defines a pair of second or side surfaces 42 against which the first (side) surfaces 30 of the mounting box 12 locate. There are matching channels 50 in each the sides 30 of the mounting box 12 and second side surfaces 42 of the recess that align when said first 30 and second 42 surfaces locate together, so that these matching channels 50 cooperatively define a dowel hole.

Each dowel hole is sized to accept two dowels 60 with a light tap fit therein in an end to end fashion. In this exemplary embodiment, each of the dowels 60 is 1 inch diameter hardened steel having a circumferential groove 62 extending there around, where this circumferential groove 62 is closer to one end of the dowel 60 than the other, so that one end of the dowel is 'a shorter end'. During assembly, each of the dowels 60 are inserted into the dowel holes formed by channels 50 so that this shorter end is directed inwardly.

There are two bolt holes 70 extending substantially through, normal to and at least partially intersecting each of the dowel holes formed by channels 50.

A bolt 72 may be located in each bolt hole 70 when and only when the recess 62 in the dowel 60 is aligned with the bolt hole 70, the bolt 72 thereby securing the dowel 60 in its dowel hole, and the dowel 60 aiding to secure the cutting element 11 to the cutting tool 10.

The bolt holes 70 within the mounting box 12 are counter-sunk and are drilled to a diameter to provide clearance between the shaft of the bolt and the bolt hole 70. In use, this assists in preventing or minimising shear loads being applied to the bolts 72.

The bolts 72 are then retained in their respective bolts holes 72 by cir-clips 74.

The underside surface 32 of the cutting element's 11 mounting box 12 comprises a generally planar face 13 that abuts against the floor surface 44 of the mounting recess 40 on the drilling tool 10, which comprises an abutment surface 14. A second set of dowel holes 15 are formed in both the planar face 13 and the abutment surface 14 on both the mounting box 12 and the drilling tool 10. A second set of dowels 16 locate within the second set of dowel holes 15 and both the planar face 13 and abutment surface 14, and are a light interference fit with the second set of dowel holes 15. In this exemplary embodiment, this second set of dowels are 1.25 inch diameter hardened steel.

The abutment surface 14 has a channel 17 and the second set of dowel holes 15 are located centrally within the channel 17. The planar face 13 of the mounting box 12 has an elongate projection 18 that fits tightly within the channel 17. Clearly, this arrangement could be reversed with the abutment surface 14 incorporating a respective elongate projection which mates with a corresponding channel located on the planar underside face 13 of mounting box 12.

The fastening means in this embodiment comprises a plurality of M24 grade steel bolts 19 and washers 24 that locate through the mounting box 12. Washers may be of the standard slit lock or serrated variety. In this embodiment NORD-LOCK™ self locking washers are used. Bolts 19 threadably engage within apertures 23 in the abutment surface 14. The apertures 20 within the mounting box 12 are counter-sunk and are drilled to a diameter to provide clearance between the shaft of the bolt 19 and the aperture 20. In use, this assists in preventing or minimising shear loads being applied to the bolts 19. Instead, the dowels 16 resist the majority of any shear load which results from drilling forces applied to the cutting elements 11 along the longitudinal axis of the drilling tool 10.

In order to assemble the attachment means to the drilling tool 10, the second set of dowels 16 are located within the second set of dowel holes 15 in the abutment surface 14. The mounting box 12 is then positioned so that the second set of dowels locates within second set of dowel holes 15 in the planar surface 13 and so that the elongate projection 18 locates within the channel 17. The bolts 19 are then engaged in the apertures 20 and tightened. Cir-clips 80 are then inserted in order to ensure that portions of bolts 19 cannot escape their respective bolt holes 20 in the event that the bolt 19 fails.

The first set of dowels 60 are then inserted into the holes for these so that half of the width of each dowel 60 is in the mounting box 12 and the other half is in the drilling tool 10, and such that their short ends are directed innermost until their longer ends are flush with the ends of the dowel hole. The dowel bolts 72 are then inserted into their respective holes 70 and tightened.

In use, any drilling forces longitudinal to the drilling tool 10 are transmitted as shear forces primarily to the second set of dowels 16. The clearance between the bolts 19 and the apertures 20 minimise any shear loading applied to the bolts 19. As the drilling tool rotates, any side forces applied normal to the longitudinal axis of the drilling tool are resisted by the first set of dowels 60 and the engagement of the elongate projection 18 within the channels 17.

Moreover, the first set of dowels 60 resist loads that would otherwise be imparted upon the bolts 19 as tension loads, thereby significantly reducing the likelihood that the bolts 19 will fail in this way.

The applicant refers to the first set of dowels 60 as "safety dowels", as one function of these is to ensure that the cutting tool 11 is retained in its mounting recess 40 in the event that bolts 19 fail. Without dowels 60 registering in aligned channels 50, the cutting element 12 would break free of the cutting tool 11 in the event that bolts 19 failed.

The cutting elements 11 can be easily removed from the drilling tool 10 by reversal of the above-described assembly process. To further facilitate removal of cutting element 11, jacking bolts 25 are screwed into the middle pair of apertures after removal of bolts 19. This pair of apertures is modified to include a screw thread which threadably engages with the shafts of jacking bolts 25. As jacking bolts 25 are screwed in they function to force mounting box 12 from abutment surface 14. This thereby simplifies the removal process for maintenance purposes particularly when compared with mounting of the cutting elements 11 to a drilling tool 10 by welding.

In a second embodiment (not illustrated), the arm of the cutting element 11, instead of being welded to a mounting box 12, may be arranged to secure directly to the drilling tool 10. In this case, the planar face 13 and associated elongate projection 18 would be on the arm 21 of the cutting element 11 and therefore would mount directly to the abutment surface 14.

Further, as an alternate to the use of a channel 17 and elongate projection 18, both the mounting box 12 in accordance with the first embodiment or the arm of the cutting element 11 in accordance with the second embodiment may locate within a channel having side walls that abut against either the mounting box 12 or the arm of the cutting element 11 so as to resist sideways loads.

With both of the embodiments, it is possible to easily remove the cutting elements for either replacement or maintenance work. As minimal loads are directly applied to the bolts holding the cutting element to the tool, there is less possibility of damage being caused to the bolts resulting in them being easier to remove.

In this specification unless the contrary is expressly stated, where a document, act or item of knowledge is referred to or discussed, this reference or discussion is not to be construed as an admission that the document, act or item of knowledge or any combination thereof was at the priority date, publicly available, known to the public, part of common general knowledge; or known to be relevant to an attempt to solve any problem with which this specification is concerned.

The invention claimed is:

1. A ground drilling or cutting tool comprising a cutting element removably attached thereto by attachment means, and releasable retention means adapted to maintain attachment of the cutting element to the tool in the event that the attachment means fails, wherein said retention means comprises:

a first surface on a side of the cutting element, a mounting recess on the cutting tool in which at least a portion of said cutting element locates, a second surface in a side of the mounting recess against which said first surface locates, channels in each of said first and second surfaces that align so as to cooperatively define a dowel hole when said first and second surfaces locate together, at least one dowel that locates in the dowel hole, and means for retaining the or each dowel within the dowel hole, and wherein the means for retaining the or each dowel comprises a recess in the or each dowel, for each dowel a bolt hole in the cutting tool extending substantially normal to and at least partially intersecting the dowel hole, for each bolt hole a bolt that locates in said bolt hole when and only when the recess in the dowel is aligned with the bolt hole, the bolt thereby securing the dowel in its dowel hole, and the dowel aiding to secure the cutting element to the cutting tool.

2. The ground drilling or cutting tool of claim 1, wherein the ground drilling or cutting tool is a hole opener or reamer.

3. The ground drilling or cutting tool of claim 1, wherein the cutting element comprises an arm supported by a base, where said base locates in the mounting recess and a side of said base is the first surface that locates against the second surface in the side of the mounting recess.

4. The ground drilling or cutting tool as in claim 3, wherein the attachment means comprises a surface on an underside of the base of the cutting element, and a further surface on a floor of the mounting recess upon which the base underside surface locates, a further set of dowel holes in each of the underside and floor surfaces, and a further set of dowels that locate in the aligned further set of dowel holes between said surfaces.

5. The ground drilling or cutting tool as in claim 3, wherein the recess in the dowel is a circumferential groove extending there around.

6. The ground drilling or cutting tool as in claim 3, wherein the recess in the dowel is a hole through the dowel.

7. The ground drilling or cutting tool as in claim 3, wherein the base comprises a pair of substantially oppositely facing side surfaces, and the recess comprises a pair of matching second surfaces in the sides thereof, where each pair of matching first and second faces cooperatively define dowel holes.

8. The ground drilling or cutting tool as in claim 7, wherein each of the two dowel holes accepts two dowels, and for each dowel there is a bolt hole receiving a bolt that registers in a circumferential groove of one of the four dowels.

9. The ground drilling or cutting tool as in claim 7, wherein there is also a provided a surface on the underside of the base of the cutting element, and a further surface on the floor of the recess upon which the base underside surface locates, a further set of dowel holes in each of the underside and floor surfaces, and a further set of dowels that locate in the aligned further set of dowel holes between said surfaces.

10. The ground drilling or cutting tool as in claim 9, wherein this further comprises engagement surfaces on the underside of the cutting element and floor of the mounting recess that extend substantially parallel to the longitudinal axis of the tool and engage to resist side loads applied to the cutting elements, and fastening means that secure the cutting elements to the tool.

11. The ground drilling or cutting tool as in claim 9, wherein these engagement surfaces comprise a channel located on the floor of the mounting recess in the drilling or cutting tool and a projection to engage the channel on the underside of the base of the cutting element.

12. The ground drilling or cutting tool as in claim 10, wherein the engagement surfaces comprise channel located on the underside of the base of the cutting element, and projection to engage the channel on the floor of the mounting recess in the drilling or cutting tool.

13. The ground drilling or cutting tool as in claim 10, wherein the further set of dowels locate within each of the dowel holes and resist movement in a direction that is parallel to the longitudinal axis of the drilling or cutting tool.

14. The ground drilling or cutting tool as in claim 10, wherein the fastening means comprises a plurality of bolts which locate through corresponding holes in the underside surface and engage in threaded holes in the floor surface.

15. The ground drilling or cutting tool as in claim 14, wherein clearance is provided between the holes in the underside surface and the bolts so that minimal shear loading is applied to the bolts.

16. An attachment means for removably securing a cutting element to a ground drilling or cutting tool, said attachment means comprising:

a first surface on a side of a cutting element, a cutting tool including a mounting recess in which at least a portion of said cutting element locates, a second surface in a side of the mounting recess against which said first surface locates, channels in each of said first and second surfaces that align so as to cooperatively define a dowel hole when said first and second surfaces locate together, at least one dowel that locates in the dowel hole, and means for retaining the or each dowel within the dowel hole, and wherein the means for retaining the or each dowel comprises a recess in the or each dowel, for each dowel a bolt hole extending substantially normal to and at least partially intersecting the dowel hole, for each bolt hole a bolt that locates in said bolt hole when and only when the recess in the dowel is aligned with the bolt hole, the bolt thereby securing the dowel in its dowel hole, and the dowel aiding to secure the cutting element to the cutting tool.

17. The attachment means of claim 16, wherein the cutting element includes an arm supported by a base, where said base locates in the recess and a side of said base is the first surface that locates against the second surface.

18. The attachment means of claim 16, wherein the recess in the dowel is a circumferential groove extending there around.

19. The attachment means of claim 16, wherein the recess in the dowel is a hole through the dowel.

20. The attachment means as in claim 16 to an attachment means, wherein the base comprises a pair of substantially oppositely facing side surfaces, and the recess comprises a pair of matching second surfaces in the sides thereof, where each pair of matching first and second faces cooperatively define dowel holes.

21. The attachment means as in claim 20, wherein each of the two dowel holes accepts two dowels, and for each dowel there is a bolt hole receiving a bolt that registers in a circumferential groove of one of the four dowels.

* * * * *

UNITED STATES PATENT AND TRADEMARK OFFICE

CERTIFICATE OF CORRECTION

PATENT NO. : 8,997,898 B2
APPLICATION NO. : 13/318727
DATED : April 7, 2015
INVENTOR(S) : Fyfe It is certified that error appears in the above-identified patent and that said Letters Patent is hereby corrected as shown below:

In the claims

Column 8,
Line 15, claim 11 "as in claim 9" should read --as in claim 10--.

Signed and Sealed this
Twenty-sixth Day of January, 2016

Michelle K. Lee

Michelle K. Lee
*Director of the United States Patent and Trademark Office*